US009466273B2

(12) United States Patent
Krol et al.

(10) Patent No.: US 9,466,273 B2
(45) Date of Patent: Oct. 11, 2016

(54) SNARE CAJÓN INSTRUMENT

(71) Applicant: DRUM WORKSHOP, INC., Oxnard, CA (US)

(72) Inventors: Andrzej J Krol, Wayne, NJ (US); Victor Filonovich, Clifton, NJ (US); Sergio G. Bonsignore, Ridgewood, NY (US)

(73) Assignee: DRUM WORKSHOP, INC., Oxnard, CA (US)

( * ) Notice: Subject to any disclaimer, the term of this patent is extended or adjusted under 35 U.S.C. 154(b) by 0 days.

(21) Appl. No.: 14/523,511

(22) Filed: Oct. 24, 2014

(65) Prior Publication Data

US 2015/0114206 A1 Apr. 30, 2015

Related U.S. Application Data

(60) Provisional application No. 61/896,021, filed on Oct. 25, 2013.

(51) Int. Cl.
*G10D 13/02* (2006.01)

(52) U.S. Cl.
CPC ..... *G10D 13/025* (2013.01); *G10D 13/02* (2013.01); *G10D 13/027* (2013.01)

(58) Field of Classification Search
CPC .. G10D 13/02; G10D 13/026; G10D 13/027; G10D 13/025
See application file for complete search history.

(56) References Cited

U.S. PATENT DOCUMENTS

| | | | | | |
|---|---|---|---|---|---|
| 478,611 | A * | 7/1892 | Knittel | G10D 13/025 | 84/415 |
| 4,026,185 | A * | 5/1977 | Migirian | G10D 13/021 | 84/411 R |
| 4,168,064 | A * | 9/1979 | Petrovic | G10D 13/02 | 473/466 |
| D288,696 | S * | 3/1987 | Hoshino | D17/22 | |
| 5,385,075 | A * | 1/1995 | Carnes | G10D 13/02 | 84/411 R |
| D571,851 | S * | 6/2008 | Myers | D17/22 | |

(Continued)

FOREIGN PATENT DOCUMENTS

| | | | | |
|---|---|---|---|---|
| DE | 202005020022 U1 * | 2/2006 | G10D 13/02 | |
| DE | 202007000686 U1 * | 5/2007 | G10D 13/02 | |

(Continued)

*Primary Examiner* — Robert W Horn
(74) *Attorney, Agent, or Firm* — Koppel, Patrick, Heybl & Philpott

(57) ABSTRACT

A snare cajón percussion instrument is disclosed. The instrument comprises a closed frame body having a plurality of sides, each side having a top portion, a bottom portion, an inner portion, and an outer portion. A rigid striking surface is securely affixed to the top portions of the plurality of sides. A snare apparatus having a brace, a fastener, and at least one snare element is securely attached to the inner portion of a first side of the frame body via the fastener and is configured to allow the snare element to alternatively contact and not contact the striking surface to produce a snare sound. The instrument may have a second striking surface that does not contact the snare apparatus and produces a cajón sound.

20 Claims, 3 Drawing Sheets

(56) References Cited

U.S. PATENT DOCUMENTS

| | | | | |
|---|---|---|---|---|
| 7,482,522 | B2 * | 1/2009 | Wening | G10D 13/02 84/411 R |
| 7,601,901 | B2 * | 10/2009 | Payerl | G10D 13/02 84/411 R |
| 8,008,560 | B2 * | 8/2011 | Wiese | G10D 13/023 84/411 R |
| D650,832 | S * | 12/2011 | Wiese | D17/22 |
| 8,115,088 | B2 * | 2/2012 | Herrera | G10D 13/02 84/411 R |
| 8,263,848 | B2 * | 9/2012 | Aspland | G10D 13/006 84/411 R |
| 8,481,834 | B2 * | 7/2013 | Eduardo | G10D 13/02 84/411 R |
| 8,487,170 | B2 * | 7/2013 | Klein | G10D 13/02 84/411 R |
| 8,735,703 | B2 * | 5/2014 | Dublin | G10D 13/02 84/411 R |
| 8,735,704 | B2 * | 5/2014 | Buchner | G10D 13/02 84/411 R |
| 8,829,321 | B2 * | 9/2014 | Klein | G10D 13/025 84/411 R |
| 8,835,733 | B2 * | 9/2014 | Boulet | G10D 13/02 84/411 R |
| D735,265 | S * | 7/2015 | Pires | D17/22 |
| 9,087,497 | B1 * | 7/2015 | Krol | G10D 13/02 |
| 9,263,010 | B2 * | 2/2016 | Trask | G10D 13/025 |
| 2014/0000436 | A1 * | 1/2014 | Klein | G10D 13/025 84/415 |
| 2014/0041508 | A1 * | 2/2014 | Trask | G10D 13/025 84/415 |
| 2014/0373699 | A1 * | 12/2014 | Drushal | G10D 13/021 84/411 R |
| 2015/0114206 | A1 * | 4/2015 | Krol | G10D 13/02 84/417 |

FOREIGN PATENT DOCUMENTS

| | | | | |
|---|---|---|---|---|
| DE | 202015001744 | U1 * | 4/2015 | G10D 13/025 |
| JP | 3184744 | U * | 7/2013 | |
| TW | 491238 | U * | 12/2014 | |

* cited by examiner

SNARE CAJÓN INSTRUMENT

This application claims the benefit of priority to U.S. Provisional Patent Application Ser. No. 61/896,021 filed Oct. 25, 2013.

FIELD OF THE DISCLOSURE

The present disclosure generally relates to percussion instruments and more particularly to a snare cajón percussion instrument.

BACKGROUND

The statements in this section merely provide background information related to the present disclosure and may not constitute prior art.

A wide variety of percussion musical instruments have been developed and used in virtually every instrument-accompanied musical genre. One type of percussion instrument, the cajón, originated in Peru and first achieved widespread popularity in the 1850s. In fact, the cajón has been the most widely used Afro-Perusian musical instrument since the $19^{th}$ century. Today, the cajón, also known as a drum kit in a box, cajón box, or Cuban box drum, is an integral part of Peruvian and Cuban music. Cajóns often accompany acoustic guitars in modern, western contemporary music. The Cajón is also becoming popular in styles such as blues, pop, rock, funk, fusion, and jazz.

Cajóns may be constructed in a variety of sizes. Typically, a cajón comprises a wooden frame. The frame may be a box, an octagon, or some other shape. The sides are constructed of half to three-quarter inch thick wood. Thinner sheets of wood (e.g., plywood) are fastened on the top and bottom sides and act as the striking surfaces or heads of the drum. This striking surface is often called the tapa. The cajón may comprise one or more sound hole openings. Alternatively, the sound hole may be positioned on the side, bottom, or top of the cajón.

Cajóns may additionally comprise one or more cords, guitar strings, rattles, or drum snares pressed against the inner surface of the tapa in order to alter the sound profile of the cajón. Such additional elements may add a buzz-like effect or tone to the cajón. The addition of guitar strings may expand the sound profile of the cajón by adding one or more frequencies to the sounds produced by the cajón. Such guitar strings must be tuned in order to produce the desired sound.

A cajón is played by tapping, slapping, and striking the tapa with the hands, feet and, in some cases, mallets. Typically, one or more edges of the tapa may be left unattached (or loosely connected) and may be slapped against the frame of the box. A cajón player typically sits astride the box and strikes the tapa located between their knees. The cajón produces markedly different sounds depending on the location the tapa is struck.

Given the foregoing, apparatuses are needed that alter the sound profile of a cajón.

SUMMARY

This Summary is provided to introduce a selection of concepts. These concepts are further described below in the Detailed Description section. This Summary is not intended to identify key features or essential features of this disclosure's subject matter, nor is this Summary intended as an aid in determining the scope of the disclosed subject matter.

Aspects of the present disclosure meet the above-identified needs by providing cajón apparatuses comprising one or more snares placed against the tapa of the cajón device. In one aspect, flexible grids, metal meshes, or similar materials are placed against a top tapa of the cajón device.

Further features and advantages of the present disclosure, as well as the structure and operation of various aspects of the present disclosure, are described in detail below with reference to the accompanying drawings.

BRIEF DESCRIPTION OF THE DRAWINGS

The features and advantages of the present disclosure will become more apparent from the Detailed Description set forth below when taken in conjunction with the drawings in which like reference numbers indicate identical or functionally similar elements.

DETAILED DESCRIPTION

The present disclosure is directed to snare cajón percussion instrument comprising one or more snares placed against a tapa of the instrument.

Figure 1:
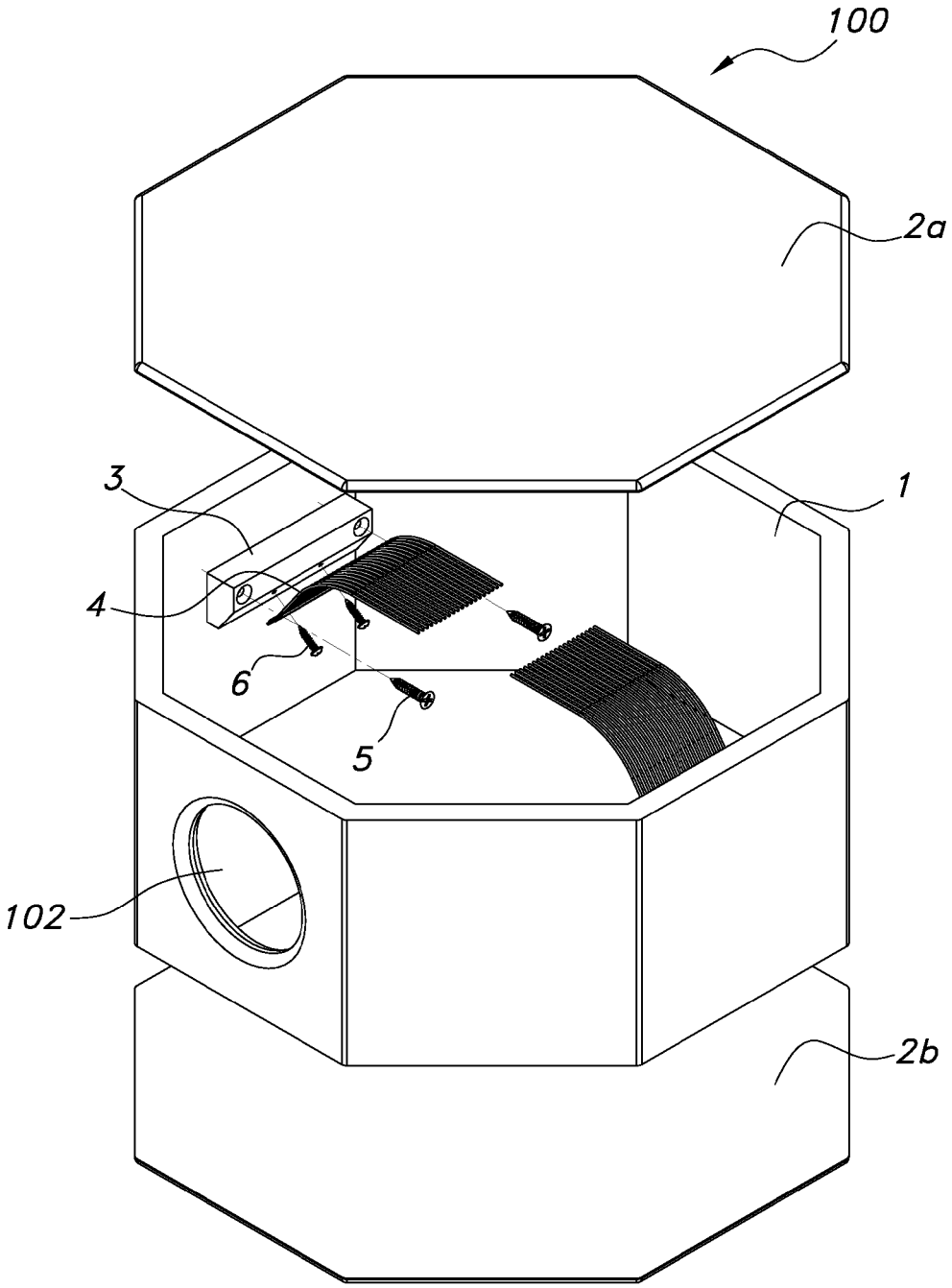
FIG. 1 is an exploded perspective view of a snare cajón instrument comprising two snares, according to an aspect of the present disclosure.
Figure 2:
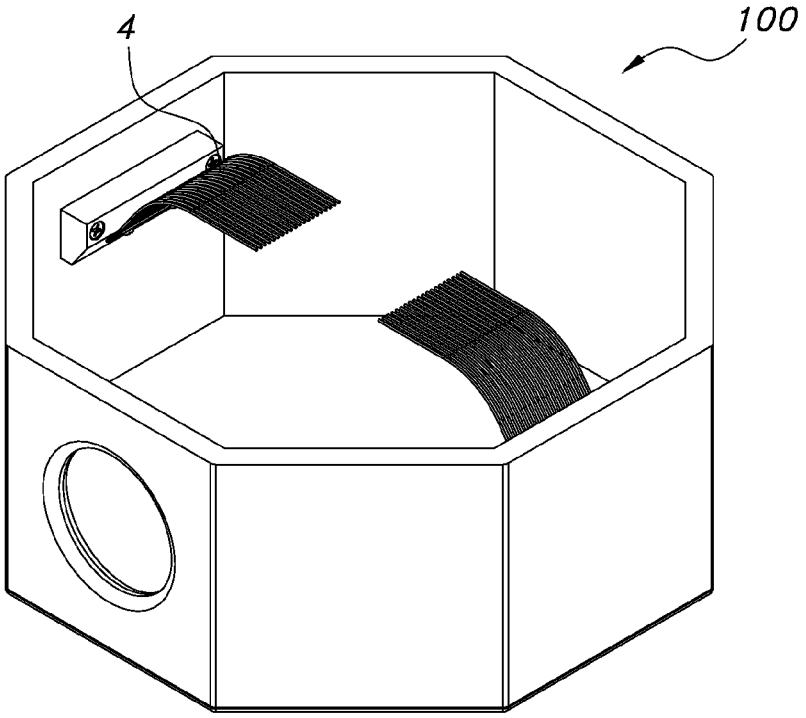
FIG. 2 is a perspective view of a snare cajón instrument comprising two snares wherein a top tapa has been removed, according to an aspect of the present disclosure.
Figure 3:
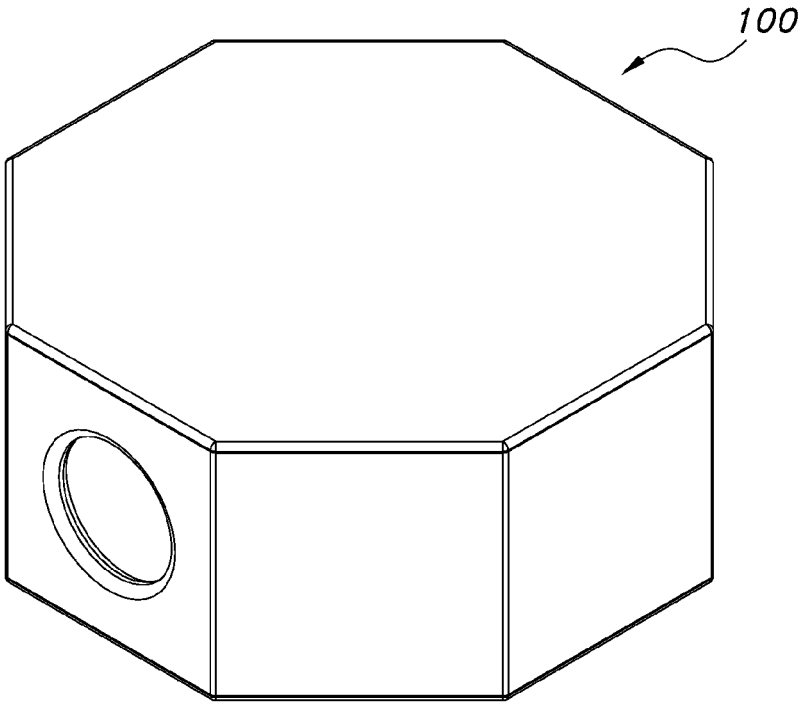
FIG. 3 is a perspective view of a snare cajón instrument, according to an aspect of the present disclosure.

Referring to FIGS. 1 through 3, various perspective views a snare cajón instrument 100, according to an aspect of the present disclosure, are shown. FIG. 1 depicts an exploded perspective view of snare cajón instrument 100 comprising two snares 4 (labeled, for clarity, only as snare 4 in FIG. 1). In FIG. 2, a top tapa 2*a* has been omitted in order to detail the interior of instrument 100. FIG. 3 depicts the assembled instrument 100.

In one aspect, flexible grids, metal meshes, or similar materials are placed against top tapa 2*a* of snare cajón instrument 100.

Instrument 100 comprises a frame 1. In an aspect, frame 1 is an octagonal structure. In such a structure, the opposing sides are parallel to each other, thereby allowing frame 1 to be held in an instrument stand, supported between the legs of a player, or supported under the arm of a player. Frame 1 may be constructed of a rigid material, such as wood.

One or more sides of frame 1 may further comprise one or more sound hole openings 102 that allow sound to emit from the instrument 100.

Instrument 100 further comprises two tapa 2, specifically top tapa 2*a* and bottom tapa 2*b*. Tapa 2 is the striking surface of instrument 100. Tapa 2 is configured to be struck, tapped, slapped, or otherwise impacted (directly by hand or via another apparatus or tool, such as a mallet, brush, or drumstick) by the player. The instrument 100 may emit a snare sound when the player strikes top tapa 2*a* by contacting snare 4 as discussed below or a cajón sound when the player strikes bottom tap 2*b*, which does not contact snare 4. In an aspect, tapa 2 is constructed of a thin piece of wood.

In another aspect, tapa 2 may constructed of a thin, flexible, durable material of natural or synthetic origin.

Tapa 2 is secured to the open side of frame 1 via one or more tapa fasteners.

Instrument 100 further comprises one or more snares 4. Snare 4 is attached to frame 1 via brace 3 and screws 5 and 6. Snare 4 is a flexible member, pre-bent and placed in close contact with tapa 2. In another aspect, snare 4 is a flexible member positioned to contact top tapa 2*a*, causing snare 4 to bend. Snare 4 may be a wire mesh, a flexible interconnected member, webbing, or a plurality of metal strings. Snare 4 may be at least partially constructed of metal, flexible polymer, and the like.

Figure 4:
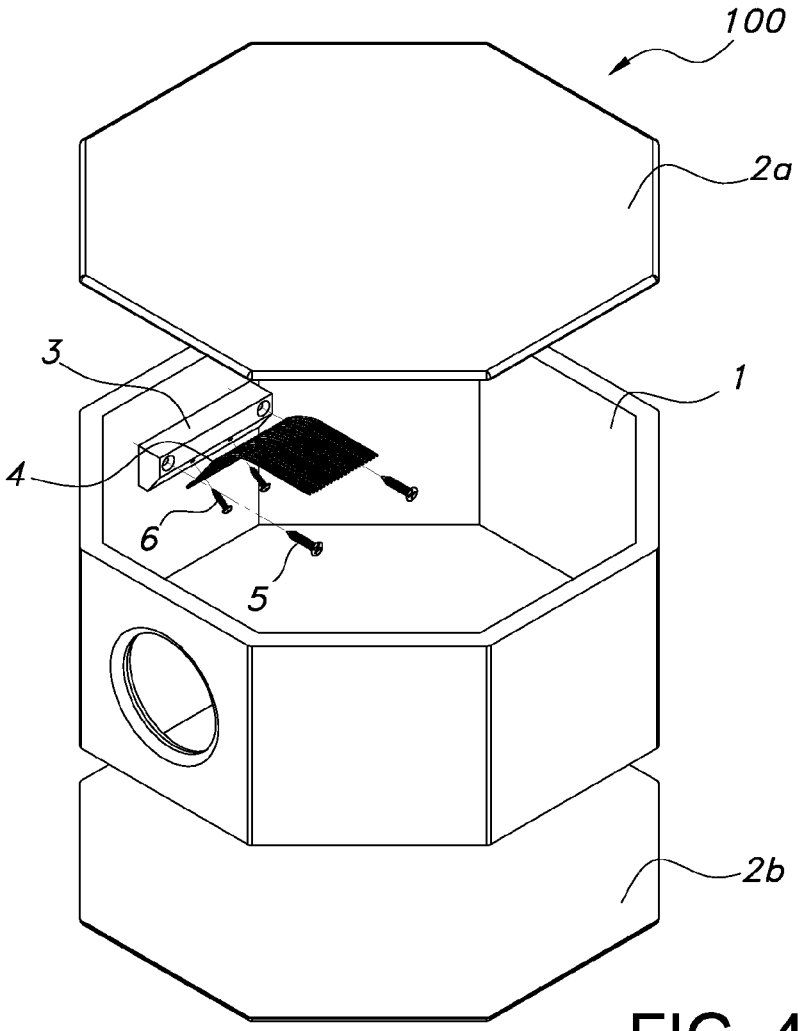
FIG. 4 is an exploded perspective view of a snare cajón instrument comprising one snare, according to an aspect of the present disclosure.
Figure 5:
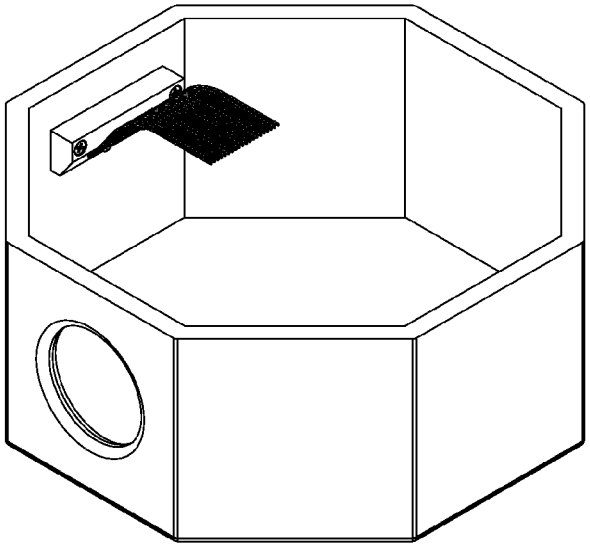
FIG. 5 is a perspective view of a snare cajón instrument comprising one snare wherein a top tapa has been removed, according to an aspect of the present disclosure.

As shown in FIGS. 1 through 3, instrument 100 may comprise two snares 4. As shown in FIGS. 4-5, in another aspect, instrument 100 may comprise a smaller diameter frame 1 and a single snare 4.

While various aspects of the present disclosure have been described above, it should be understood that they have been presented by way of example and not limitation. It will be apparent to persons skilled in the relevant art(s) that various changes in form and detail can be made therein without departing from the spirit and scope of the present disclosure. Thus, the present disclosure should not be limited by any of the above described exemplary aspects.

In addition, it should be understood that the figures in the attachments, which highlight the structure, methodology, functionality and advantages of the present disclosure, are presented for example purposes only. The present disclosure is sufficiently flexible and configurable, such that it may be implemented in ways other than that shown in the accompanying figures (e.g., implementations embodied as percussion instruments other than those mentioned herein). As will be appreciated by those skilled in the relevant art(s) after reading the description herein, certain features from different aspects of the systems, methods and apparatuses of the present disclosure may be combined to form yet new aspects of the present disclosure.

What is claimed is:

1. A percussion instrument, comprising:

a closed frame body comprising a plurality of sides, each side comprising a top portion, a bottom portion, an inner portion, and an outer portion;

at least one rigid striking surface securely affixed to the top portions of the plurality of sides; and a first snare apparatus comprising a first brace, a first fastener, and a first snare element;

a second snare apparatus comprising a second brace, a second fastener, and a second snare element;

wherein the first snare apparatus is securely attached to the inner portion of a first side of the frame body via the first fastener and configured to allow the first snare element to alternatively contact and not contact the striking surface to produce a snare sound; and wherein the second snare apparatus is securely attached to the inner portion of a second side of the frame body via the second fastener and configured to allow the second snare element to alternatively contact and not contact the striking surface to produce a snare sound.

2. The percussion instrument of claim 1, wherein at least one of said first and second snare elements is a flexible member.

3. The percussion instrument of claim 2, at least one of said first and second snare elements comprising at least one point of curvature that enables it to make contact with the striking surface at a plurality of points simultaneously.

4. The percussion instrument of claim 2, wherein at least one of said first and second snare elements is configured to curve at at least one point upon making contact with the striking surface in order to enable it to make contact with the striking surface at a plurality of points simultaneously.

5. The percussion instrument of claim 1, wherein each of said snare elements comprises one of the group consisting of: a wire mesh; a flexible interconnected member; webbing; and a plurality of metal strings.

6. The percussion instrument of claim 1, the frame body having eight or fewer sides.

7. The percussion instrument of claim 1, the at least one fastener comprising one of: a screw, a nail, and a bolt.

8. The percussion instrument of claim 1, wherein at least one of the sides is shaped to define an opening that permits sound to emit from the instrument.

9. The percussion instrument of claim 1, further comprising a second striking surface securely affixed to the bottom portion of the plurality of sides.

10. The percussion instrument of claim 9, the second striking surface configured to produce a cajon sound.

11. The percussion instrument of claim 1, the second side of the frame body positioned parallel to the first side of the frame body.

12. The percussion instrument of claim 1, wherein said first snare apparatus is configured to allow the first snare element to alternatively contact and not contact the underside of the striking surface, and wherein said second snare apparatus is configured to allow the second snare element to alternatively contact and not contact the underside of the striking surface.

13. The percussion instrument of claim 9, wherein said first and second striking surfaces are substantially flat.

14. The percussion instrument of claim 1, wherein the height of the frame body is less than the width of the frame body.

15. A percussion instrument, comprising:

a frame body comprising a top portion, a bottom portion, an inner portion, and an outer portion;

at least one rigid striking surface securely affixed to the top portion of the frame body; and a first snare apparatus comprising a first brace, a first fastener, and a first snare element;

a second snare apparatus comprising a second brace, a second fastener, and a second snare element;

wherein the first snare apparatus is securely attached to the inner portion of the frame body via the first fastener and configured to allow the first snare element to alternatively contact and not contact the striking surface to produce a snare sound; and wherein the second snare apparatus is securely attached to the inner portion of the frame body opposite said first snare apparatus, the second snare apparatus attached to the inner portion of the frame body via the second fastener and configured to allow the second snare element to alternatively contact and not contact the striking surface to produce a snare sound.

16. A percussion instrument, comprising:

a frame body comprising a plurality of sides, each side comprising an inner surface and an outer surface;

a panel on a top of said frame body; and a first snare apparatus comprising a first snare element;

a second snare apparatus comprising a second snare element;

wherein the first snare apparatus is attached to the inner portion of a first side of the frame body and is configured to allow the first snare element to alternatively contact and not contact the panel to produce a snare sound; and wherein the second snare apparatus is attached to the inner portion of a second side of the frame body and is configured to allow the second snare element to alternatively contact and not contact the panel surface to produce a snare sound.

17. The percussion instrument of claim 16, the frame body having eight or fewer sides.

18. The percussion instrument of claim 16, wherein each of said first and second snare elements comprises one of the group consisting of: a wire mesh; a flexible interconnected member; webbing; and a plurality of metal strings.

19. The percussion instrument of claim 16, further comprising a second panel on a bottom of said frame body;

wherein the topside of said second panel is free of snare element contacts such that said second panel produces a cajon sound when actuated.

20. The percussion instrument of claim 16, wherein the height of said frame body is less than the width of said frame body.

* * * * *